US009437385B1

(12) United States Patent
Mittelstadt

(10) Patent No.: US 9,437,385 B1
(45) Date of Patent: Sep. 6, 2016

(54) MINIATURE CIRCUIT BREAKER FOR A NO-TOUCH LOAD CENTER

(71) Applicant: SCHNEIDER ELECTRIC USA, INC., Palatine, IL (US)

(72) Inventor: Chad R. Mittelstadt, Cedar Rapids, IA (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 0 days.

(21) Appl. No.: 14/802,574

(22) Filed: Jul. 17, 2015

(51) Int. Cl.
*H01H 9/02* (2006.01)
*H01H 71/02* (2006.01)

(52) U.S. Cl.
CPC ..... *H01H 71/0264* (2013.01)

(58) Field of Classification Search
CPC .... H01R 13/447; H01R 35/04; H01R 31/06; H01R 13/60; H01H 9/02; H01H 9/0264
See application file for complete search history.

(56) References Cited

U.S. PATENT DOCUMENTS 4,620,076 A * 10/1986 Mrenna ..... H01H 9/0264 200/304
4,918,258 A 4/1990 Ayer
5,594,398 A * 1/1997 Marcou ..... H01H 83/04 335/18
6,242,702 B1 * 6/2001 Spiegel ..... H02B 11/02 200/296
6,249,197 B1 * 6/2001 Zindler ..... H01H 71/08 200/293
2002/0121952 A1 * 9/2002 Castonguay ..... H01H 1/2041 335/132
2010/0020453 A1 * 1/2010 McCoy ..... H01H 71/1018 361/42
2010/0134221 A1 * 6/2010 Mittelstadt ..... H01H 11/0006 335/9
2010/0164657 A1 * 7/2010 Mittelstadt ..... H01H 71/7409 335/9
2013/0328657 A1 * 12/2013 Broghammer ..... H01H 71/04 337/79
2014/0014482 A1 * 1/2014 Kim ..... H01H 71/025 200/293

* cited by examiner

*Primary Examiner* — Briggitte R Hammond
(74) *Attorney, Agent, or Firm* — Locke Lord LLP

(57) ABSTRACT

A miniature plug-on circuit breaker and complementary Load Center breaker compartment provide no exposed live touch points in the load center. The miniature circuit breaker has all terminals surrounded by its case. Line power and line side neutral terminals are accessed through the bottom of the circuit breaker. Load power and load side neutral terminals are accessed from an end panel of the circuit breaker. Load power and load side neutral terminals are covered such that they can only be wired when the circuit breaker is not in a breaker compartment of the complementary Load Center. Cover biasing features, or interference features, or both, can be provided so that an open load side terminal cover will have the cover closed upon insertion to the load center, and to prevent a closed load side terminal cover from being opened on an inserted circuit breaker.

8 Claims, 11 Drawing Sheets

MINIATURE CIRCUIT BREAKER FOR A NO-TOUCH LOAD CENTER

FIELD OF THE INVENTION

The present disclosure relates to methods and systems for inserting and removing a circuit breaker from an electrical panel or panelboard, and more particularly to a method and apparatus for reducing the chances of exposure to live parts in the panelboard.

BACKGROUND OF THE INVENTION

An electrical panel or panelboard, has a main bus and individual connection points on the bus that are connectable to electrical devices, such as circuit breakers for branch conductors and any other electrical devices designed to be installed for a branch circuit. Because the circuit breakers, sometimes referred to herein simply as 'breakers" for convenience, and other branch electrical devices are typically mounted directly to the panelboard, an operator and/or tools may come in contact with exposed conductors in the panelboard when installing or removing the circuit breakers from the panelboard. Thus, it is recommended that power be shut off to the panelboard as a precaution when electrical devices are being installed or removed. However, it may be considered desirable in some cases to keep the panelboard energized to prevent an electrical hazard as a consequence of deenergization, or operators may intentionally keep the power on in the interest of saving time. Moreover, shutting off power to the panelboard can be a major inconvenience, especially for data centers, hospitals, and other critical applications that require a high availability power source.

Thus, a need exists for an improved way to safely insert and remove a circuit breaker or other switching equipment from an electrical panel as part of a larger scheme for installing and removing branch circuit devices without deenergizing the electrical panel. Measures to prevent unintentional contact with live, i.e. energized, conductors are often known as "finger safe" provisions. Work on energized equipment may be referred to herein as 'live work". A particular subset of panelboards, called load centers, are front-accessible, wall-mounted panelboards, and typically for low voltage light, heat or power circuit applications, which have miniature circuit breakers to define and protect each branch circuit. Due to their size, design, and economic constraints, load center-type panel boards can present unique challenges for the above considerations.

SUMMARY OF THE DISCLOSED EMBODIMENTS

The embodiments disclosed herein are directed to a circuit breaker compatible with methods and systems for reducing or eliminating the possibility of exposure to live parts in a panelboard, and particularly in the load center variety of panelboard, and safely installing and removing a circuit breaker or other branch electrical devices from the energized panelboard. While the illustrated embodiments are explained with load centers in mind, and the terms "load center" and "panelboard" may sometimes be used interchangeably herein, the present invention is not necessarily limited to the miniature circuit breaker load center environment.

The disclosed embodiments provide a circuit breaker for insertion into a circuit breaker compartment of a complementary load center. The circuit breaker has an overall box-shaped, e.g. parallelepiped, case as its exterior shell. The six sides of the preferred breaker case include a top panel, a bottom panel with a terminal-surrounding extension, two opposing side panels, and front and end panels. All terminals of the circuit breaker are located within the exterior dimensions of the case. The line side terminals, being line power terminals and line side neutral terminals, when present, of the circuit breaker are located at the bottom of the circuit breaker, and protrude through the solid bottom panel of the case. The line terminals are surrounded on four sides by a case extension. The line terminals then access the bus stabs through the open bottom of the case extension. This arrangement leads to enclosed connections between the line terminals and the line side busses of the complementary panelboard. The load side terminals, that is the load power and load side neutral terminals, which are individually wired, are accessed through openings in the end panel of the case. The load side terminal arrangement includes covers for the openings in the end panel.

These covers are arranged such that the load power and load side neutral terminals can only have wires attached thereto, i.e. be wired, when the circuit breaker is not in the circuit breaker compartment of the complementary load center. The covers are also arranged so that an open cover of a nonwired load side terminal will have that cover closed upon insertion of the circuit breaker into the load center. A wired circuit breaker with an open load side terminal cover will, of course, have the cover remain open upon insertion into the load center due to the wire being in the terminal.

Any features for opening the circuit breaker load side terminal covers are prevented from being used on an inserted circuit breaker such that once the circuit breaker is inserted into the load center, the covers cannot be opened. This prevents later wiring attempts from possibly contacting a live conductor. Use of interference features, such as locating the features used to open the covers in inaccessible areas behind the load center's circuit breaker compartment, may be used. In addition, or in conjunction with interference features, biasing features can be used to bias the terminal covers closed.

In certain embodiments the complementary load center includes shutter assemblies attached in the circuit breaker compartments which serve as access barriers to the line side busses of the panelboard. Keying features on the circuit breaker case are then provided whereby the access barriers to the line side terminals are circumvented, i.e. opened or unlocked, upon insertion of the circuit breaker to the circuit breaker compartment. In some embodiments the circuit breaker is designed so that inserting it in the panelboard in a Z-axis motion depresses a shutter plate of the shutter assembly in a Z-axis motion and allows the line side terminals of the circuit breaker to access the conductors in the panelboard, which also extend in the Z-axis. When the circuit breaker is removed from the panelboard, the shutter plate again closes off access to the conductors. A panelboard containing such a Z-axis shutter assembly is illustrated and described in Applicant's concurrent U.S. patent application Ser. No. 14/802,483 [CRC-0307], which is incorporated by reference herein in its entirety.

In some implementations, the circuit breaker may have keying features such as inclined planes on lower portions of the case of the circuit breaker, for example, on the side walls thereof. As the circuit breaker is inserted in the panelboard, the inclined planes act as a keying mechanism to line up with spring latches holding the shutter plate in the protective upward position, until the flat sides of the breaker engage the springs and push them out of the way. When the circuit breaker is removed from the panelboard, the shutter plate is forced upward by a bias spring on the bottom side thereof and the latches move back into the circuit breaker compartment to latch the shutter plate in the protective position.

The breakers in certain aspects of the invention are preferably equipped with positive retention interlocks providing a hold down mechanism and an interlock which will not allow the breaker to be inserted or removed in the ON position, thereby further increasing the safety of live work. Such interlocks were illustrated previously in Applicant's U.S. patent application Ser. No. 14/449,881 [CRC-0298] which is incorporated by reference herein in its entirety.

BRIEF DESCRIPTION OF THE DRAWINGS

The foregoing and other advantages of the disclosed embodiments will become apparent upon reading the following detailed description and upon reference to the exemplary drawings according to one or more embodiments disclosed herein, wherein.

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1A:
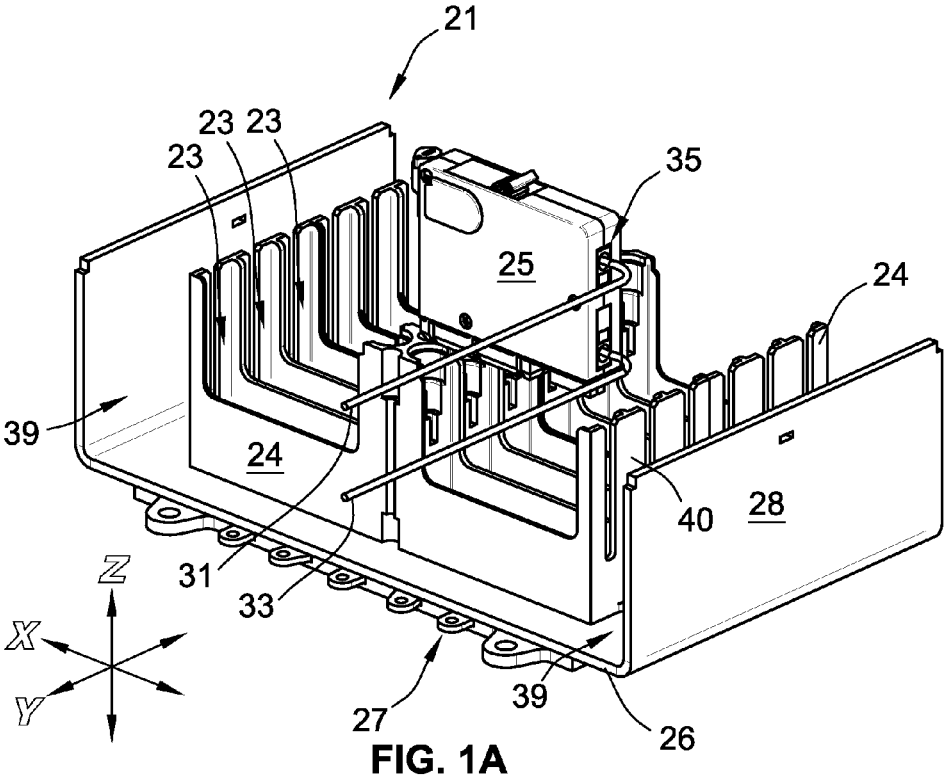
FIGS. 1A and 1B show top right perspective views of the circuit breaker compartment portions of an exemplary panelboard with a wired breaker in uninstalled and installed positions, respectively, according to one or more embodiments disclosed herein, with descriptive axes of direction indicated thereon.
Figure 1B:
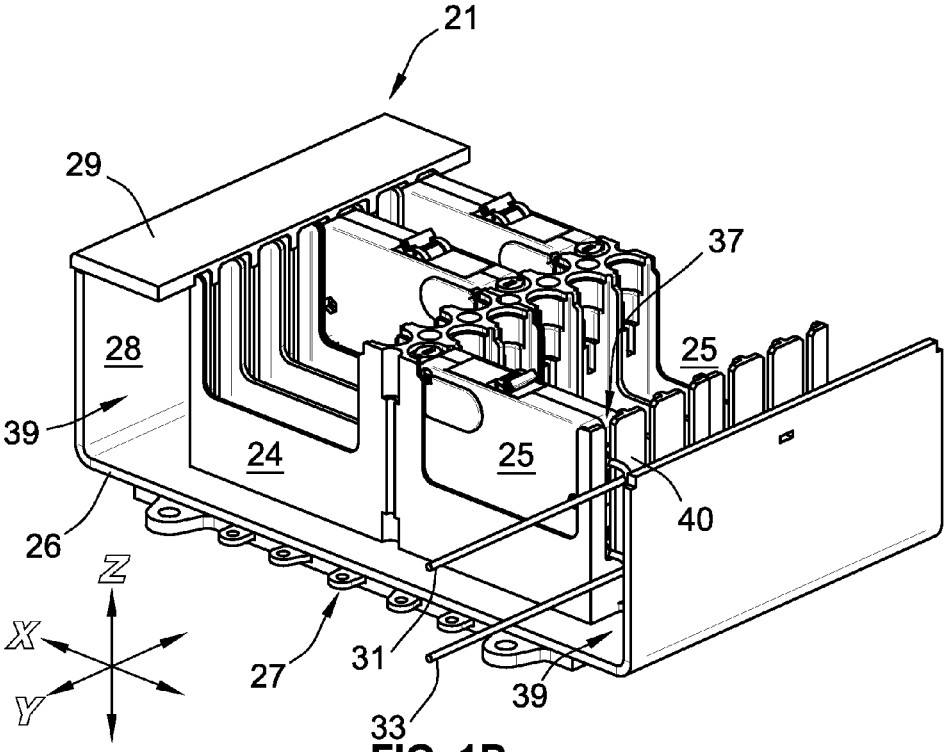

Referring to FIGS. 1A and 1B, a partial load center 21 is shown according to the disclosed embodiments. It will be appreciated that various other covering and enclosing structure may form a finished version of the load center, including for example a removable wiring gutter cover 29 shown in FIG. 1B, end caps, and the like. The load center 21 provides a plurality of circuit breaker compartments, sometimes referred to herein as "wells," collectively 23, in which circuit breakers, collectively 25, may be mounted in order to connect to conductors, i.e. busses, collectively 27, in the load center 21. As shown, the wells 23 are formed in a one-piece unitary assembly of nonconductive material in an overall box-shape having one open side.

FIG. 1A illustrates the required prewiring of the circuit breaker 25 prior to insertion in the panel board 21, with branch load line 31 and branch neutral line 33, i.e. the load power and load side neutral lines which are individually wired to their breakers, being inserted and captured in the interior of the circuit breaker case and exiting through an end panel 35 of the circuit breaker 25. FIG. 1B illustrates the inserted circuit breaker 25 in its well 23 with branch load and neutral lines 31, 33 respectively, exiting through a slot 37 in the well 23 communicating with a wiring gutter 39.

Figure 2:
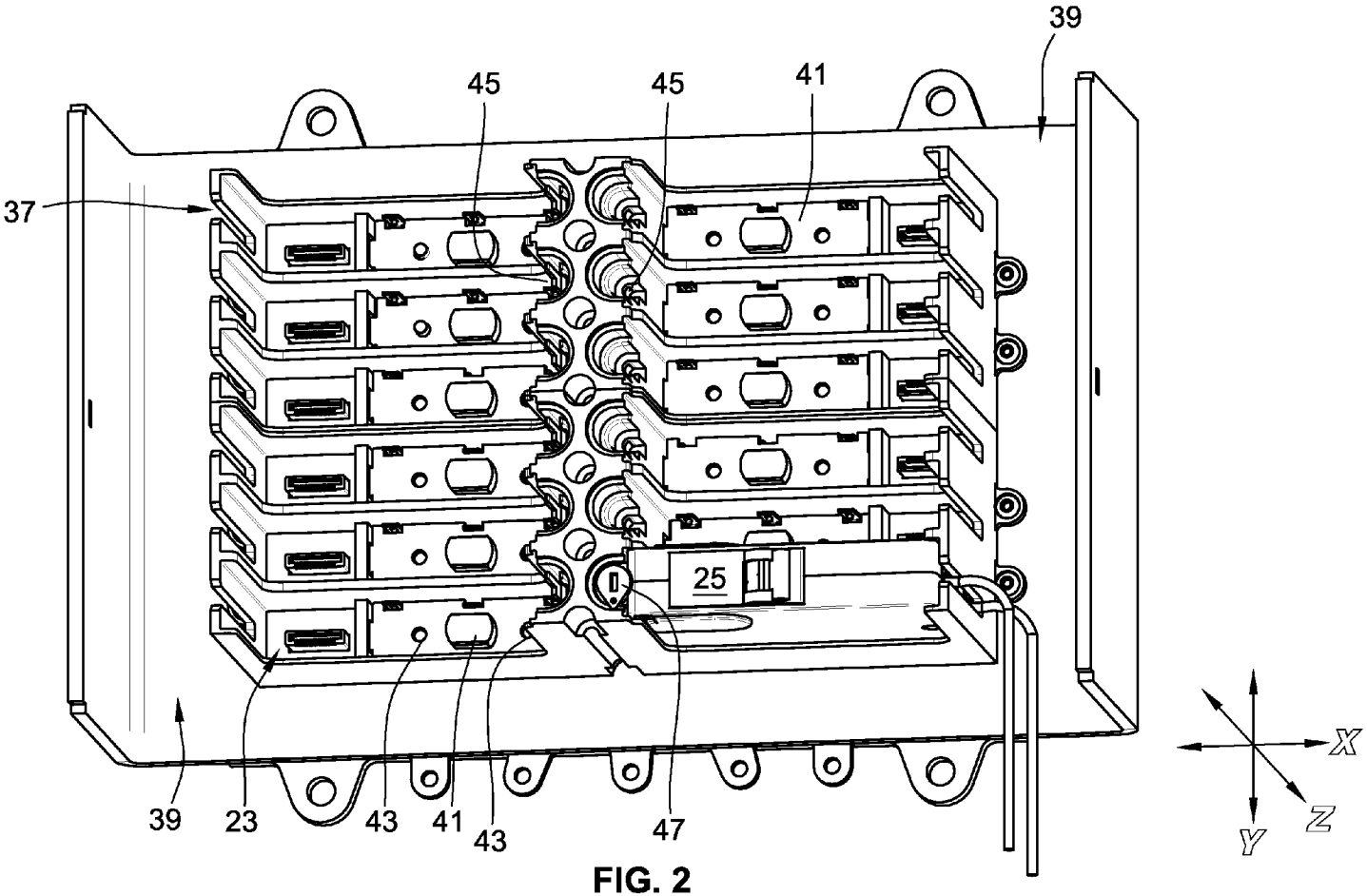
FIG. 2 shows a top perspective view of the compartment portions with an exemplary wired breaker in one compartment and shutter assemblies in the bottom of the other compartments.

FIG. 2 shows a top perspective view of the compartment portions with an exemplary breaker 25 in the lower right well and shutter plates, collectively 41, in the bottom of the other wells. Visible in the two through-holes of each of the shutter plates 41 are the nonconductive caps 43 covering the bus stabs. Also visible in FIG. 2 are the receptacles 45 for a positive retention interlock 47 (FIG. 10) of the circuit breaker 25.

Figure 3B:
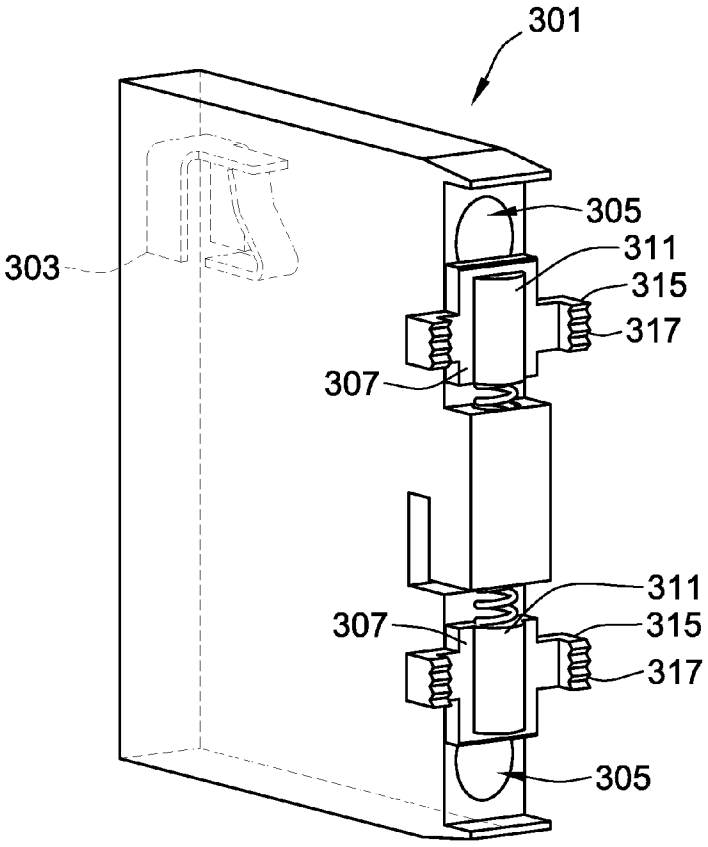
FIGS. 3A and 3B show an exemplary spring-biased cover system for the load side terminals of the circuit breaker.
Figure 3A:
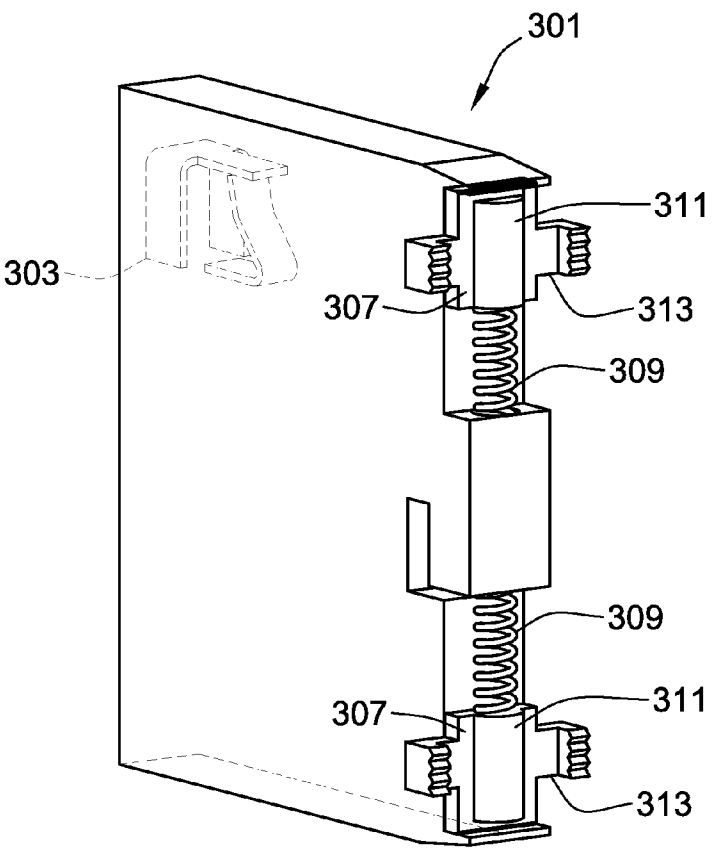
Figure 4B:
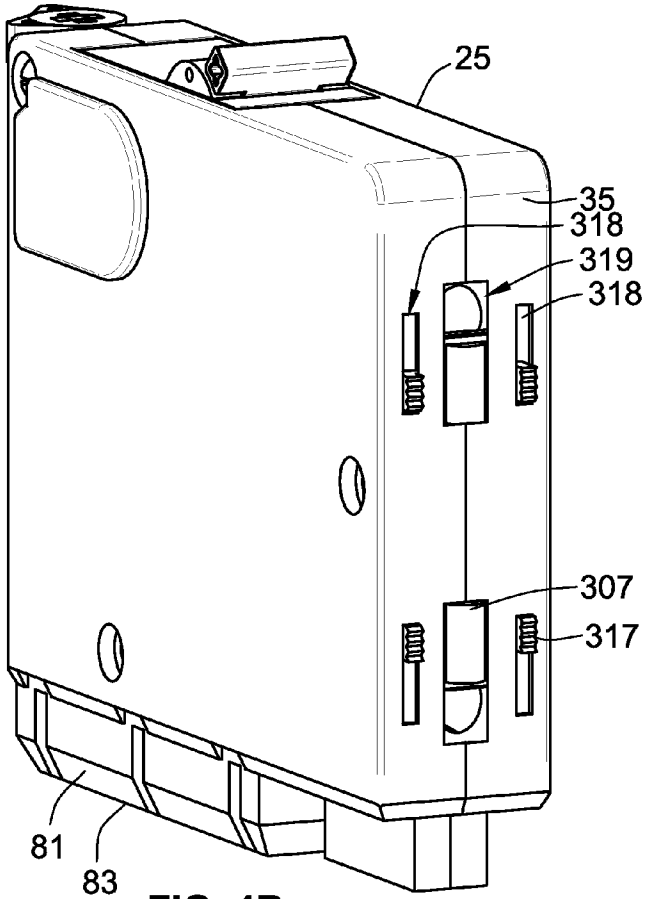
FIGS. 4A and 4B show a circuit breaker with the exemplary spring-biased cover system, in closed and opened positions respectively.
Figure 4A:
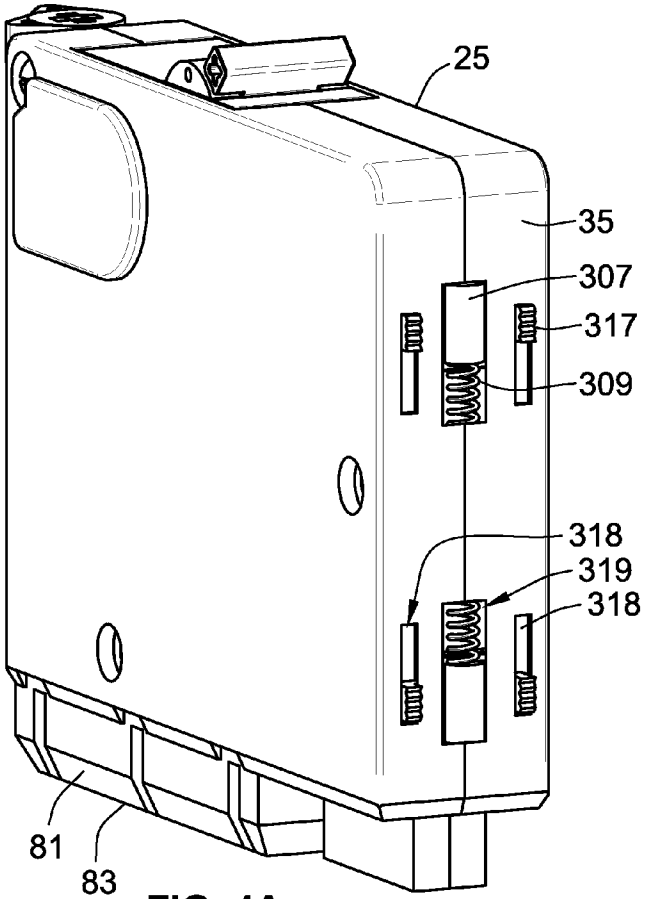
Figure 10:
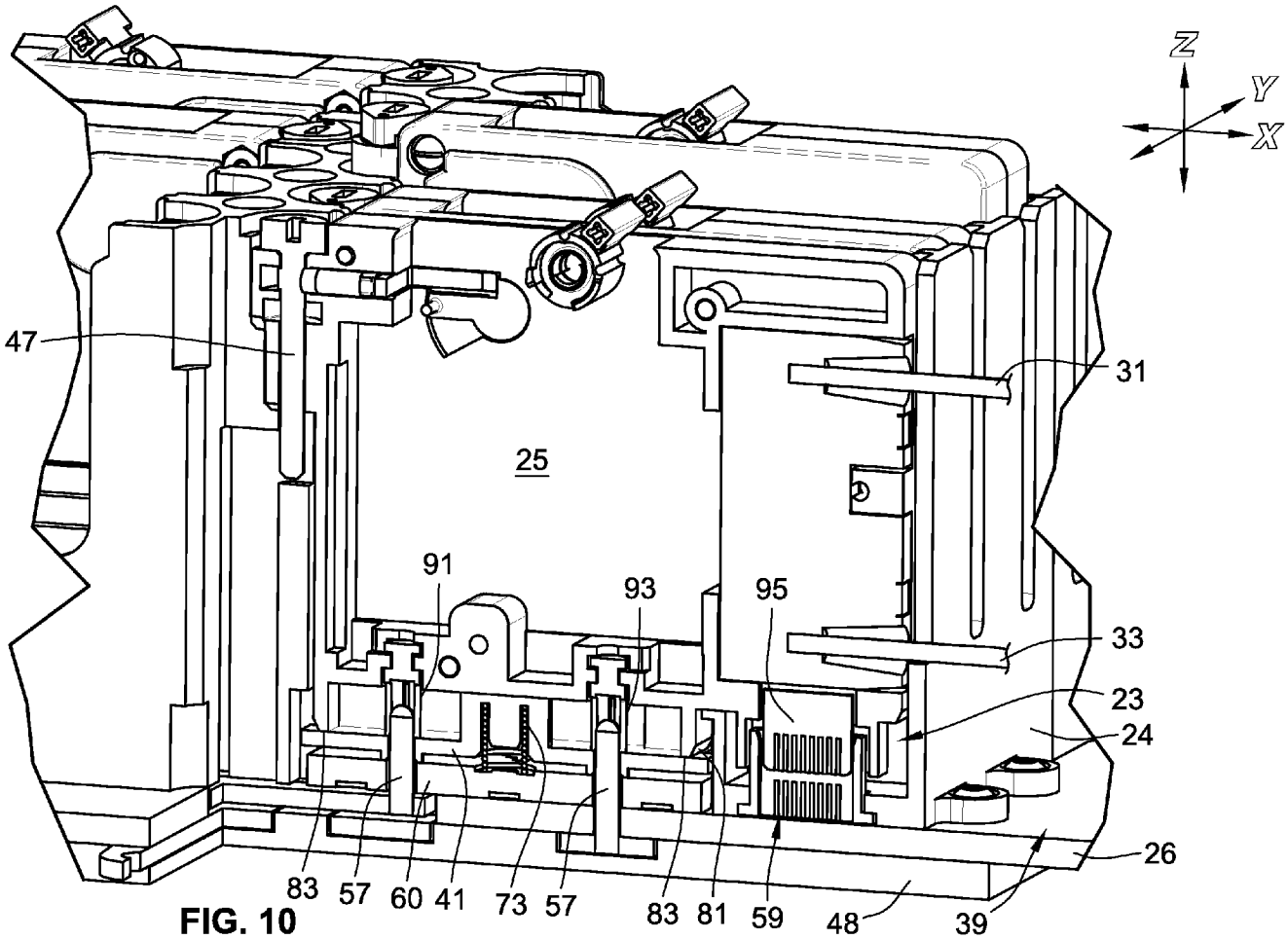
FIG. 10 shows a medial sectional perspective through the X-Z plane of an exemplary shutter assembly, a circuit breaker in engagement with the bus structure; the compartment, and a wiring gutter.
Figure 11:
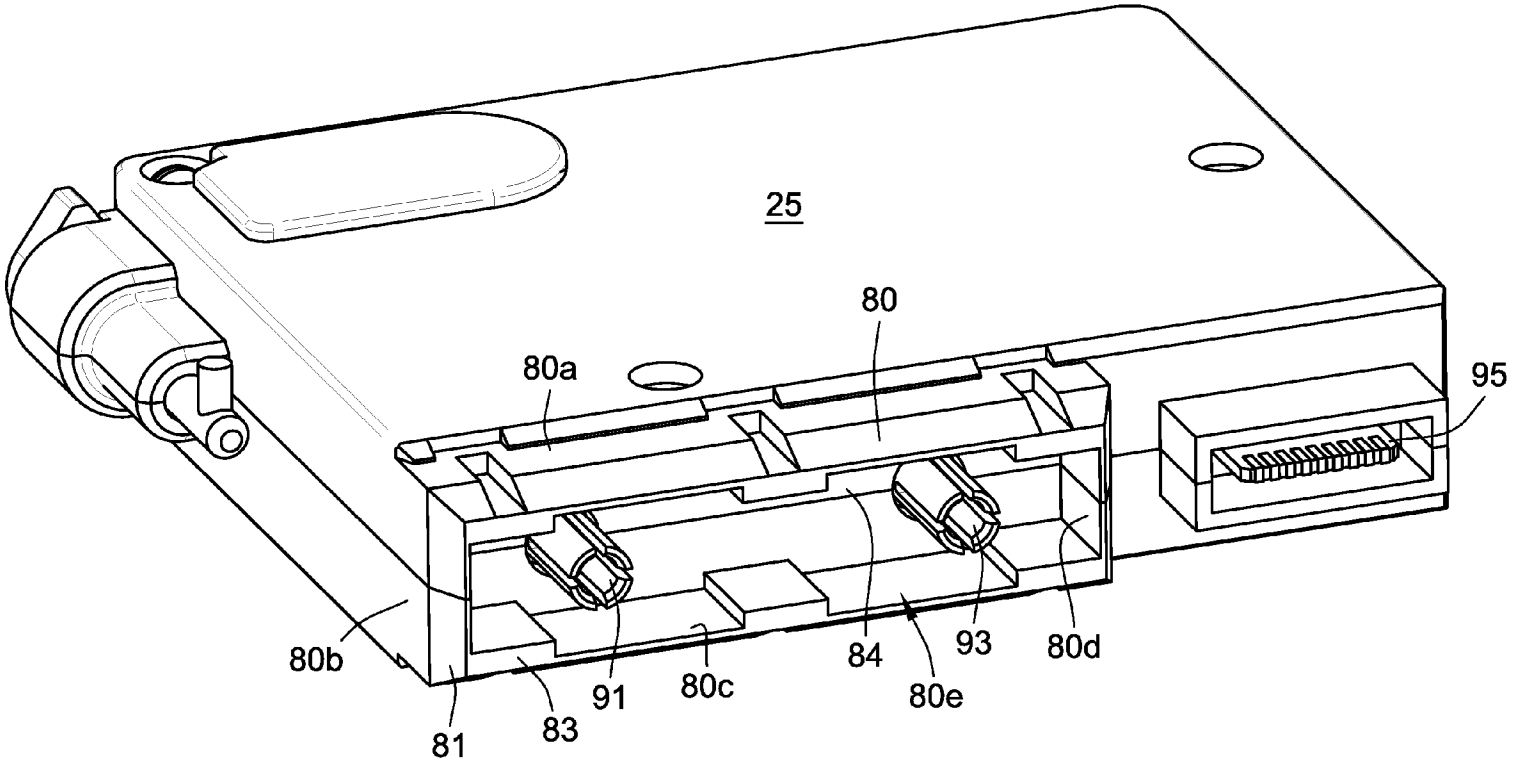
FIG. 11 shows a bottom front perspective view of an exemplary breaker with side and bottom panels and the line side terminals in the view.

FIGS. 3A-3B show a terminal subassembly 301 providing embedded screwless load side terminals 303 of any desired type, here represented in phantom view with spring clip terminals. The terminal subassembly 301 has openings, collectively 305, to the embedded terminals 303. Covering each entry opening 305 to the terminals is a cover, collectively 307. The terminal subassembly 301 is ultimately contained within the substantially boxlike case of the exemplary circuit breaker 25 (FIGS. 4A-4B). The covers 307 are biased by coil springs, collectively 309, to a position covering the openings 305. The covers 307 include a central covering plate 311 for blocking access to openings 305 and side arms, collectively 313, extending from the sides of the plates 311. Side arms 313 provide side tab extensions 315 with forwardly facing knurled surfaces 317 for manual operation to move the cover 307 from in front of the openings 305 when wiring insertion is desired. FIGS. 4A and 4B show the end panel 35 of the circuit breaker with the terminal subassembly 301 captured therein. The end panel 35 has appropriate openings to allow movement of the covers 307 between the closed and open positions of FIGS. 4A and 4B, respectively. As illustrated, the side tab extensions 315 with knurled surfaces 317 are contained in their own slots 318 of the breaker case on each side of an opening 319 for the central covering plate 311. FIG. 11 shows a bottom front perspective view of a breaker 25 with line side power and neutral terminals 91, 93 respectively, in the view. The line side terminals, 91, 93 of the circuit breaker are located at the bottom of the circuit breaker 25, and protrude through a solid bottom panel 84 of the breaker case. The line side terminals are also surrounded by a case extension 80 on four sides 80*a*,80*b*,80*c*,80*d* with an open bottom 80*e*. The case extension 80 helps define the exterior dimensions of the case and may be an integrally formed part of the breaker case. The line terminals can then access the bus stabs of the complementary panelboard through the open bottom 80*e* of the case extension 80. This arrangement provides enclosed connections between the line terminals and the line busses of the complementary panelboard, as seen in FIG. 10.

Figure 5A:
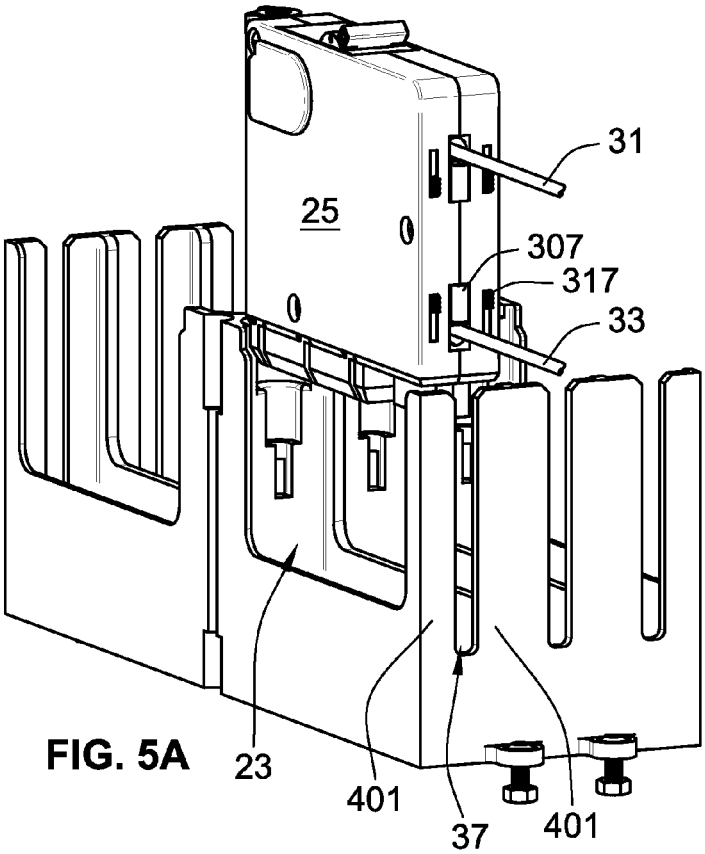
FIGS. 5A and 5B show a wired circuit breaker with the exemplary spring-biased cover system outside of, and inside of, the complementary circuit breaker compartment, respectively.
Figure 5B:
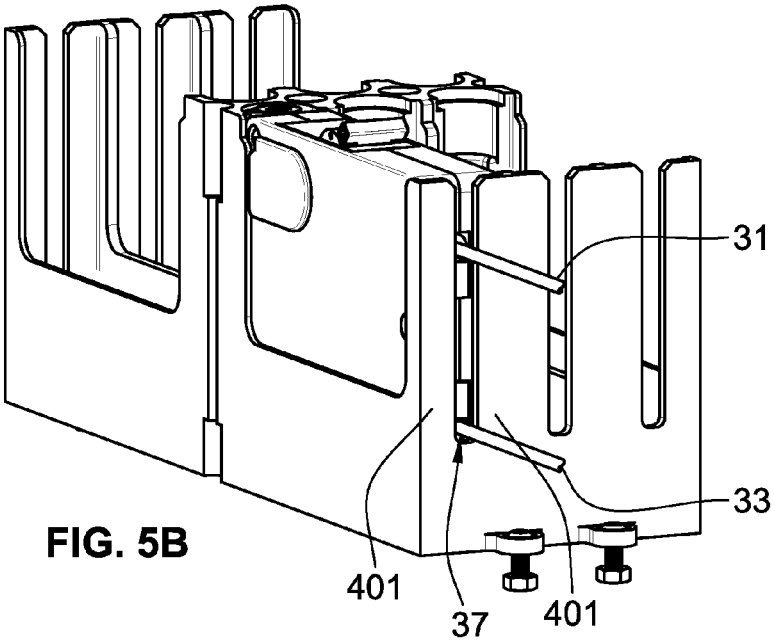

Referencing FIGS. 5A-5B, the exemplary circuit breaker 25 is now wired with a load side power wire 31 and a load side neutral wire 33. FIG. 5A shows the wired circuit breaker 25 prior to insertion into a circuit breaker compartment 23 of the panelboard 21 (FIG. 1). FIG. 5B shows the wired circuit breaker 25 after insertion into the circuit breaker compartment 23 of the panelboard 21 (FIG. 1). Upon insertion, the load side wires 31, 33 exit through a slot 37 in the circuit breaker compartment 23 communicating with a wiring gutter 39 (FIG. 1). The slot 37 preferably is closely sized to provide the minimum gap between the insulation of the wires 31, 33 and the compartment walls, collectively 401. Once a circuit breaker is inserted, no further access to the interior load side terminals is available. The knurled surfaces 317 of the covers 307 are hidden in the interior of the compartment 23 behind the walls 401 on either side of slot 37 thereby making further wiring attempts practically impossible. Were an unwired circuit breaker to be inserted into the circuit breaker compartment 23, the covers 307 would remain closed, the knurled surfaces 317 for operating the cover would be hidden, and there would be no exposed conductors.

Figure 6:
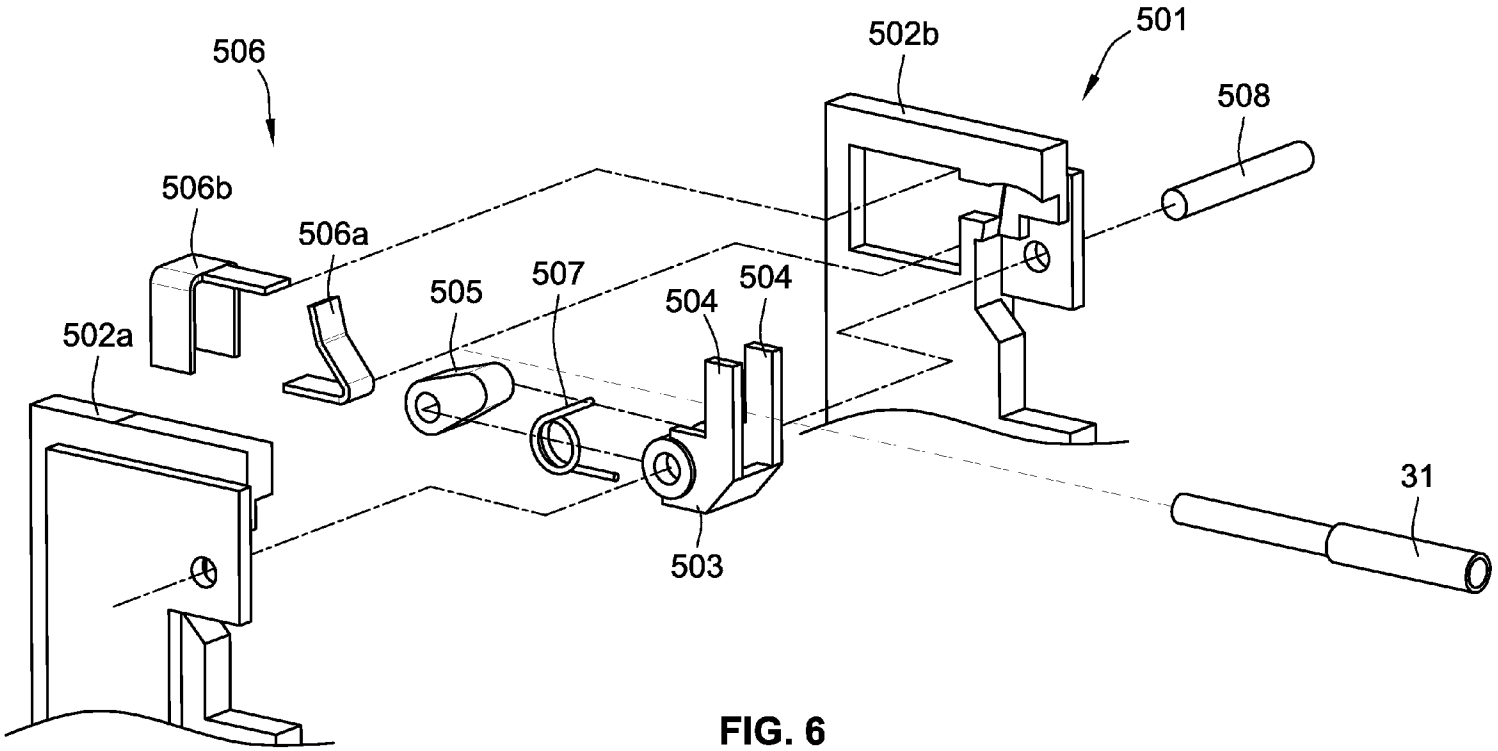
FIG. 6 shows and exploded view of an alternative terminal cover arrangement utilizing a lever and door arrangement
Figure 7A:
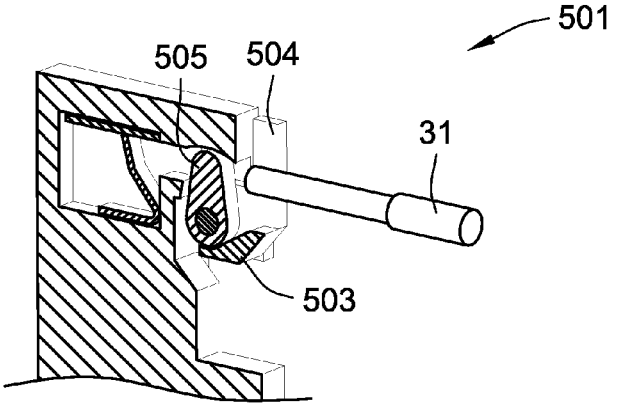
FIGS. 7A through 7C show a cross section through the upper half of a terminal subassembly with the alternative terminal cover arrangement of FIG. 6.
Figure 7B:
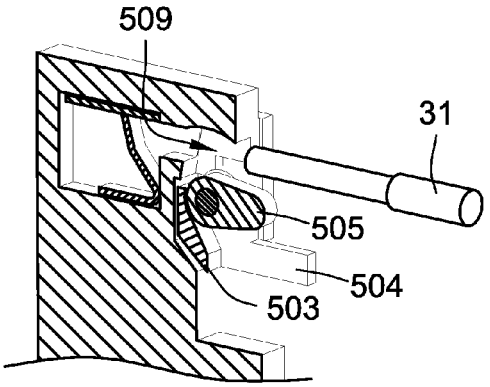

FIGS. 6 and 7A-7C, illustrate an alternative embodiment terminal opening cover mechanism on a partial terminal subassembly 501. FIG. 6 shows an exploded view of the partial terminal subassembly 501 with two case halves 502*a*, 502*b* surrounding a spring-clip terminal 506 with a clip 506*a* and wiring harness 506*b*. The spring clip terminal 506 is held in the case halves behind a door piece 505 and a yoke 503 rotate together about an axle 508. FIG. 7A illustrates the closed position wherein a U-shaped yoke 503 cradles a door piece 505. The door piece 505 and yoke 503 are linked by a wire loop 507 allowing the door piece 505 to follow the position of the yoke 503. In the covered, or closed, position the lever arms 504 are in the up position and the door piece 505 covers the opening 509 (FIG. 7B) to the terminal connection inside the terminal subassembly 501. FIG. 7B illustrates the uncovered, or open, position wherein the lever arms 504 of the yoke 503 are in the down position and the door piece 505 uncovers the opening 509 to the terminal connection inside the terminal subassembly 501.

Figure 7C:
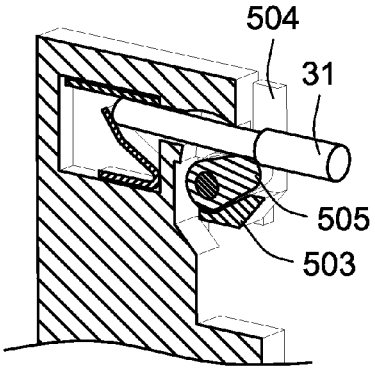

When the terminal is wired, as in FIG. 7C, the terminal cover is placed in the closed position by lifting the lever arms 504 of the yoke 503. If left in the open position, upon insertion of the terminal subassembly/circuit breaker into the circuit breaker compartment, whether wired or not, the lever arms 504 will be forced upward into a closed position by contact with the circuit breaker compartment walls 401 (FIGS. 5A-5B). The wire loop 507 allows for a hysteresis whereby when the yoke 503, as seen in FIG. 7C, is placed in the up or closed position the door piece 505 will rest upon a wire connected to the terminal, e.g., a load side wire 31, without excessive force. Once the breaker is inserted, the lever arms 504 are hidden in the interior, and behind the walls 401, of the circuit breaker compartment and the terminal subassembly 501 is no longer able to be accessed or opened.

Figure 8:
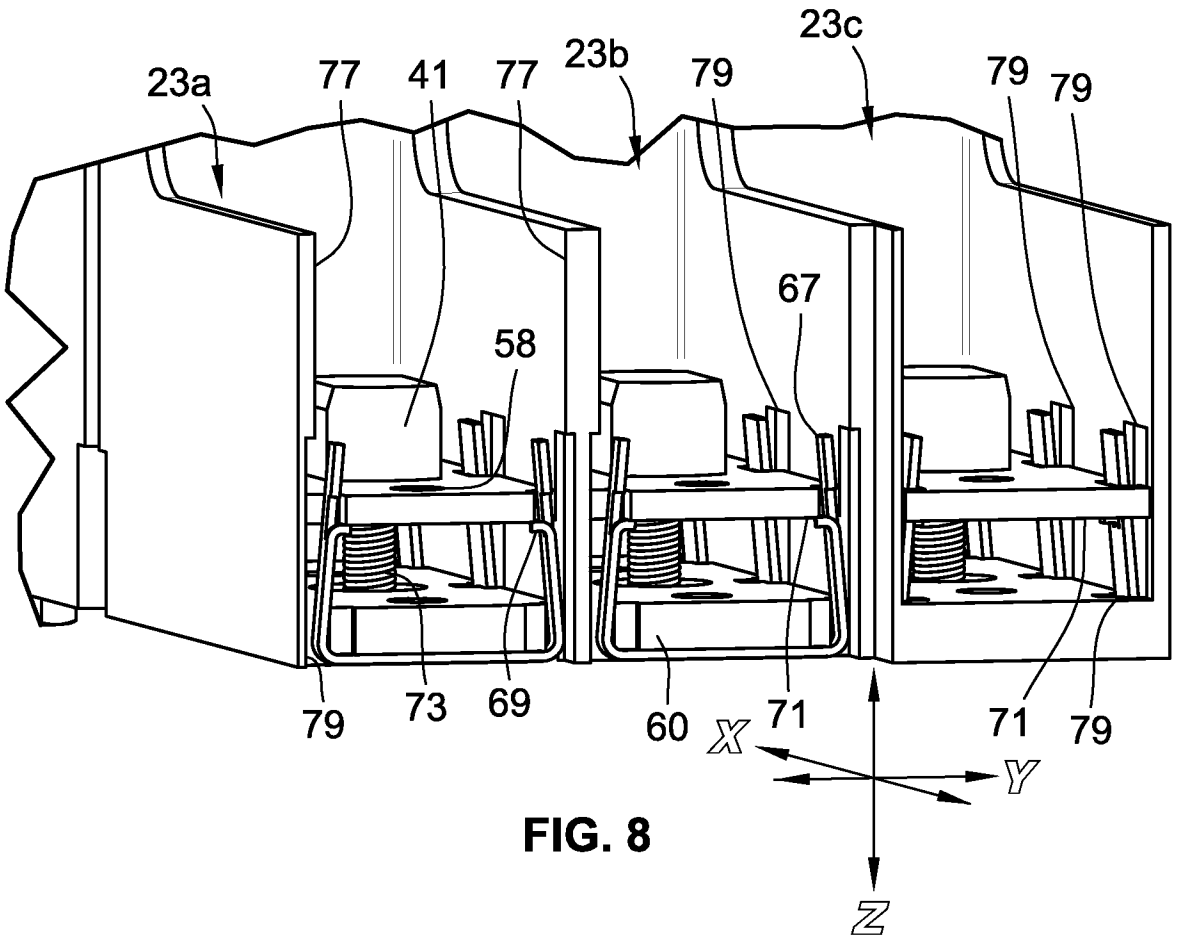
FIG. 8 shows details in perspective view of a partial circuit breaker compartment with a shutter assembly therein.

FIG. 8 shows further details of a circuit breaker compartment 23 complementary to the illustrated breakers 25. Within the compartment 23 is a shutter assembly acting as an access barrier for preventing unintended panelboard connection to the line side terminals of the circuit breaker (91, 93, FIG. 10). The shutter assembly includes a nonconductive shutter plate 41 supported in the raised and protected position by latches 67 engaging the shutter plate 41. The latches 67 are in the form of U-shaped flat springs with the curve of the U held in place by a section of the bottom plate 60 of the nonconductive one-piece unitary assembly 24 forming the circuit breaker compartments 23. The upwardly extending arms of the U-shaped flat springs have inward facing tabs 69 upon which rest the bottom surface 71 of the shutter plate 41. A coil spring 73 is placed between the bottom surface 71 of the shutter plate 41 and the bottom surface 75 of the circuit breaker compartment 23 to bias the shutter plate 41 upwardly in the Z axis towards the raised or protected position in which it is latched. The side walls 77 of the circuit breaker compartment 23 have cut outs 79 providing a space into which the latches can be pushed by a circuit breaker to unlatch the shutter plate 41 and allow it to move downwardly to the lowered and unprotected position (FIGS. 9-10).

Figure 9:
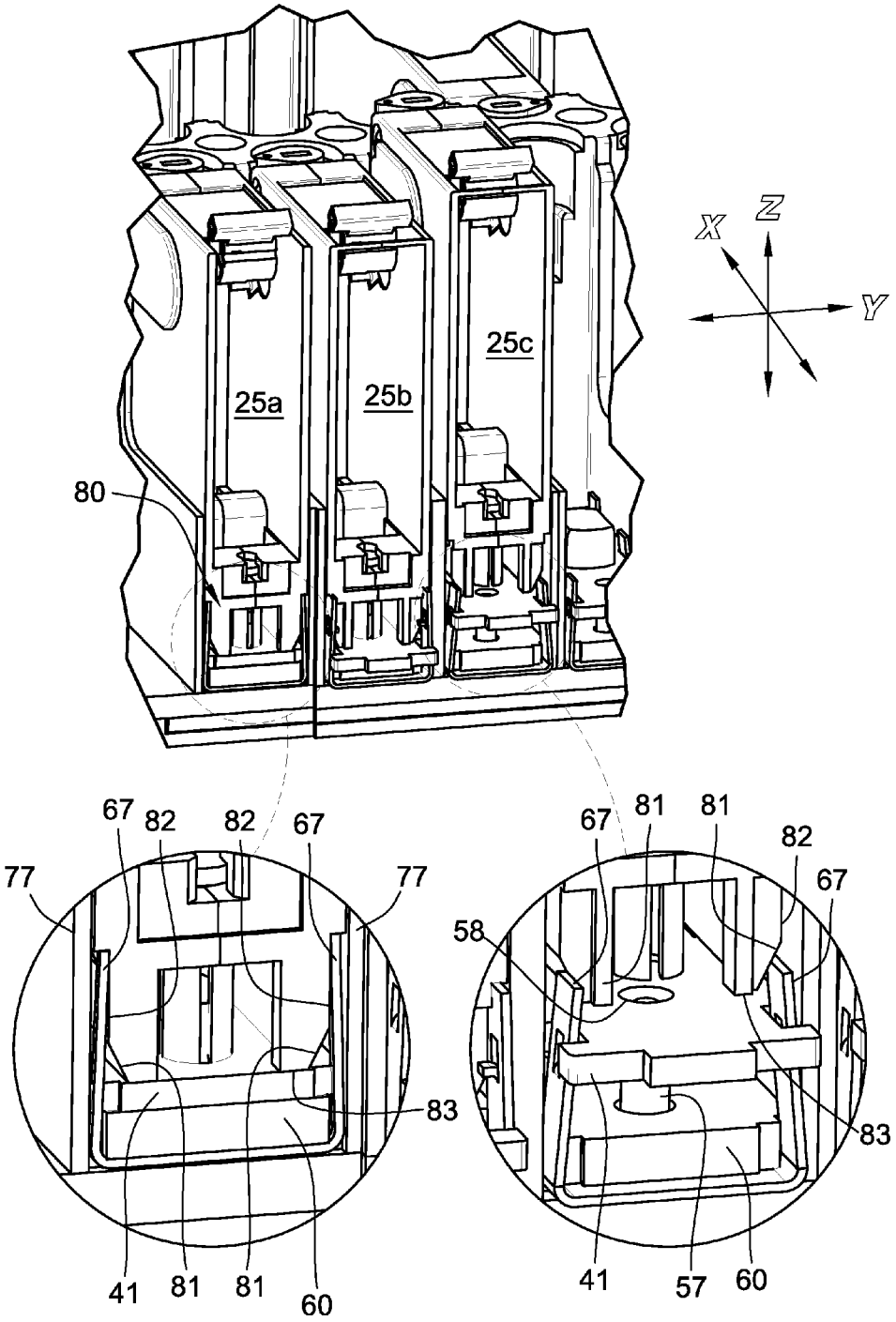
FIG. 9 shows a medial sectional perspective through the Y-Z plane of exemplary circuit breakers, compartments and bus structure in different stages of engagement with the shutter assemblies.

Referring to FIG. 9, cross sections of two circuit breakers 25*a*, 25*b* are shown in the fully inserted position while a third 25*c* is shown in a partially inserted position. It will be noted that the circuit breaker compartment is shown here as being a well with sides that extend in the Z axis to substantially cover the depth of the breaker 25 when inserted to further minimize access to live conductors. The lower portions 81 of the case extension sides 80*a*-80*d* (FIG. 11) meeting the bottom edge 83 of the case extension 80 are inclined or beveled in order to act as keying features and gradually force the latches 67 towards side walls 77 until the sides of the case extension 80 become flat to force the latches fully open, thereby allowing the shutter plates 41 to be forced down by the bottom edge 83 of the case extension 80. As seen in FIG. 10, once the circuit breaker 25 is fully inserted with a Z axis motion, the shutter plate 41 is fully depressed in the Z axis allowing the load and neutral female terminals 91, 93 inside the case extension 80 of the circuit breaker 25 to make electrical contact with the line side vertical bus stabs, collectively 57. Appropriate shaping of the bottom surface of the circuit breaker and the top surface of the shutter plate may be accomplished in the design. As discussed above, the previously attached branch load and neutral wires 31, 33 exit the well 23 through slot 37 (FIG. 1B) into the wiring gutter 39. The communication port 59 of the well has accepted the corresponding connector 95 on the circuit breaker 25 outside of the shutter plate area. The positive retention interlock 47 has been fastened, securing the circuit breaker in the well and allowing it to be placed in the ON position.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the scope of the disclosed embodiments as defined in the appended claims.

What is claimed is:

1. A circuit breaker for insertion into a circuit breaker compartment of a complementary panelboard, the circuit breaker comprising:

a) a box-like case with top and bottom panels, opposing side panels, and front and end panels, the bottom panel having a terminal-surrounding case extension with an open bottom;

b) all terminals of the circuit breaker being located within exterior dimensions of the case, with i. line side terminals, being line power and line side neutral terminals, being accessed at an open bottom edge of the case extension, ii. load side terminals, being load power and load side neutral terminals, which are accessed through the end panel;

c) covers for openings in the end panel arranged such that the load power and load side neutral terminals can only have wires attached thereto when the circuit breaker is not in the circuit breaker compartment of the complementary panelboard, and d) the covers arranged so that a wired circuit breaker with an open load side terminal cover will have the cover remain open, and i) an open cover of a nonwired load side terminal will have the cover closed upon insertion of the circuit breaker into the panelboard;

ii) the covers further arranged such that features for opening the covers are prevented from being used on an inserted circuit breaker; and e) keying features on the circuit breaker case whereby access barriers in the circuit breaker compartment for preventing panelboard connection to the line side terminals are circumvented upon insertion of the circuit breaker to the circuit breaker compartment.

2. The circuit breaker according to claim 1 wherein the load side terminals are screwless.

3. The circuit breaker according to claim 1 wherein the covers include a door operated by a lever system.

4. The circuit breaker according to claim 1 wherein the covers include a spring biased cover opened by side tabs which are inaccessible when the circuit breaker is inserted into the circuit breaker compartment.

5. The circuit breaker according to claim 1 wherein the keying features are inclined planes meeting the bottom edge of the case extension.

6. The circuit breaker according to claim 1 wherein the circuit breaker further has positive retention interlock features.

7. The circuit breaker according to claim 1 wherein the circuit breaker is a miniature circuit breaker.

8. The circuit breaker according to claim 1 wherein openings in the circuit breaker case for line side terminals are in the bottom panel.

* * * * *